US007647867B2

(12) United States Patent
Byron

(10) Patent No.: US 7,647,867 B2
(45) Date of Patent: Jan. 19, 2010

(54) APPARATUS AND METHOD FOR IMPRINTING VIALS

(76) Inventor: Kent Byron, 314 School Board Dr., New Iberia, LA (US) 70560

( * ) Notice: Subject to any disclaimer, the term of this patent is extended or adjusted under 35 U.S.C. 154(b) by 158 days.

(21) Appl. No.: 11/895,987

(22) Filed: Aug. 27, 2007

(65) Prior Publication Data

US 2009/0056568 A1 Mar. 5, 2009

(51) Int. Cl.
*B41F 17/26* (2006.01)

(52) U.S. Cl. ..... 101/37; 101/35

(58) Field of Classification Search ..... 101/35, 101/37; *B41F 17/22, 17/26, 17/36*
See application file for complete search history.

(56) References Cited

U.S. PATENT DOCUMENTS 3,059,572 A * 10/1962 Young ..... 101/37
3,735,697 A * 5/1973 Proven ..... 101/37
5,570,632 A 11/1996 Cumens et al.
7,124,681 B2 10/2006 Louviere

* cited by examiner

*Primary Examiner*—Leslie J Evanisko
(74) *Attorney, Agent, or Firm*—Jones Walker

(57) ABSTRACT

An apparatus for printing onto closed vial units. The vial units are formed in a series and the vial units have a drug therein. The apparatus comprises a conveyor belt for moving the vial units, with the conveyor belt having spaced cleats. A first side of the vial units is placed on the conveyor belt. The apparatus further comprises a printhead for printing an ink pattern onto the vial units, with the printhead configured to print to the first side, and a back-up roller configured opposite the printhead, with the back-up roller being a cylindrical member that contains an indented profile placed about the cylindrical member reciprocal to the vial units. The apparatus further includes a dryer positioned to receive the vial units from the printhead and provide for drying of the ink pattern from the printhead.

17 Claims, 9 Drawing Sheets

APPARATUS AND METHOD FOR IMPRINTING VIALS

BACKGROUND OF THE INVENTION

This invention relates to an apparatus and method for imprinting a vial. More particularly, but not by way of limitation, this invention relates to an offset printing system and method for printing onto a vial.

A method of producing a series of interconnected vials was disclosed in my co-pending patent application bearing Ser. No. 11/639,640, filed on 15 Dec. 2006 which is a continuation application of U.S. Pat. No. 7,168,366, issued 30 Jan. 2007, which are incorporated herein by reference.

Users of the vials will require information of the type of material contained within the container. In the situations wherein the vials contain medicine, certain information such as type of medicine, dosage amount, manufacturer, expiration date, etc. is very important. Additionally, the number of vials filled and the lot from which material originated is also very important. Prior art techniques include printing onto a label, and then placing the label onto the vial. However, this is undesirable for several reasons. First, the placement of the labels onto the vials is a highly inefficient and time consuming process. Additionally, the type of ink and/or glue used must not be toxic or environmentally unsafe since the ink and/or glue has a possibility of contaminating the material contained within the vial, or alternatively, the ink making the outer portion of the vial unsanitary.

Hence, there is a need for an apparatus to imprint onto a container. There is a further need to imprint onto a series of interconnected vials. There is also a need for printing onto both sides of a vial unit. There is also a need for printing onto a container filled with a substance such as a pharmaceutical drug. Still further, there is a need to imprint a label that is safe to the user and the environment. There is also a need to print onto a plastic article that is irregular in size and shape. These and many other needs will be met by the following invention.

SUMMARY OF THE INVENTION

An apparatus for printing onto closed vial units is disclosed. In the preferred embodiment, the vial units are formed in a series and the vial units have an inner portion filled with a drug, with the vial units having an open end and a closed end. The apparatus comprises a conveyor belt for moving the vial units, with the conveyor belt having spaced cleats, and the vial units having a first side and a second side, and wherein the second side is placed on the conveyor belt in a horizontal orientation.

The apparatus further comprises a first offset inking transfer device for printing a first ink pattern onto the vials, with the first side offset inking transfer device configured to print to the first side, and a first back-up roller configured opposite the first offset inking transfer device, with the first back-up roller being a cylindrical member that contains an indented profile placed about the cylindrical member and wherein the indented profile is reciprocal to the outer contour of the vial units. The apparatus further includes a first ultra violet dryer positioned to receive the vials from the first offset inking transfer device and provide for drying of the ink pattern from the first offset inking transfer device.

The apparatus may further comprise means for flipping the vial units on the conveyor belt from laying on the second side to laying on the first side, a second offset inking transfer device for printing a second ink pattern onto the vials, with the second offset inking transfer device configured to print to the second side, and a second back-up roller configured opposite the second offset inking transfer device, with the second back-up roller being a cylindrical member and wherein the second back-up roller contains an indented profile placed about the cylindrical member and wherein the indented profile is reciprocal to the outer contour of the vial units. The apparatus may further include a second ultra violet dryer positioned to receive the vials and provide for drying of the ink pattern from the second offset ink transfer device. In one embodiment, the first and second back-up rollers are rotatably mounted so that the roller rotates in phase with the advancement of the vial units. Also in one preferred embodiment, the vial unit contains a tip portion and a body portion, and wherein said indented portion contains a receptacle tip portion and a receptacle body portion.

The apparatus may further comprise a vial remover comprising a second conveyor belt to dispense the vial units and a brush configured to orient and position the vial units adjacent the cleats. In the most preferred embodiment, the apparatus also contains a hopper for feeding vial units onto a track; and, a photo-eye device, positioned downstream of the hopper, for determining whether the vials are positioned adjacent the cleats and transmitting a signal to a control means if the vial units are improperly positioned on the track. The apparatus may further include a laser engraver, positioned downstream of the first ultra violet dryer, in order to engrave an alpha numeric number onto the vials and a plasma treater means, positioned upstream of the first offset inking transfer device, for surface treating the vials in preparation of printing the ink pattern on the vial units.

In another preferred embodiment, an apparatus for imprinting closed vial units is disclosed. In this embodiment, the vial units are formed in a series, with the vial units having an inner portion filled with a drug. The apparatus comprises a hopper for holding the vial units and delivering the vial units to a conveyor belt, and a conveyor belt for moving the vial units. The apparatus further comprises a first offset inking transfer device for printing a first ink pattern onto the vial units, with the first offset inking transfer device configured to print to the first side, a first back-up roller configured opposite the first offset inking transfer device, with the first back-up roller being a cylindrical member and wherein the first back-up roller contains an indented profile placed about the cylindrical member reciprocal to the vial units, and a first ultra violet dryer positioned to receive the vials from the first offset inking transfer device and provide for curing of the ink pattern from the first offset inking transfer device. The apparatus may also include means for flipping the vial units on the conveyor from laying on the second side to the first side and a brush configured to orient the vial units adjacent the notches/cleats.

A method of imprinting a series of vial units is also disclosed. The method comprises providing the series of vial units onto a conveyor belt, positioning the vial units adjacent cleats on the conveyor belt, engaging a first offset inking transfer device on a first side of the vial units, and engaging a first back-up roller against the vial units, with the back-up roller being placed opposite the first offset inking transfer device. The method further includes capturing the vial units between the first back-up roller and the first offset inking transfer device, printing onto the vial units with a first offset inking transfer device, and curing the ink with a first ultra violet dryer. The method may further comprise flipping the vial units on the conveyor belt, engaging a second back-up roller against the vial units, with the second back-up roller being placed opposite a second offset inking transfer device, and capturing the vial units between the second back-up roller and the second offset inking transfer device. The method further includes printing onto the vials with a second offset inking transfer device, curing the ink with a second ultra violet dryer, and removing the vials down stream of the second ultra violet dryer so that the vial units are removed from the mandrel. In one preferred embodiment, the first back-up roller comprises an indented profile configured to engage with the vial units, and the step of capturing the vial units includes engaging an outer contour of the vial units with the indented profile of the first back-up roller. The method may also the step of engraving the vial units with an alphanumeric code.

Also disclosed is a method of imprinting a series of plastic containers. This method comprises providing the containers onto a track, and wherein the containers are placed on a first side and a second side of the container is positioned on the track. The method includes advancing a first offset inking transfer device against the first side of the containers, advancing a back-up roller against the second side of the containers, capturing the containers on indented profiles formed on an outer cylindrical surface of the back-up roller, printing onto the first side of the containers with a first offset inking transfer device, and curing the ink with a first ultra violet dryer. The method further comprises flipping the containers so that the first side is positioned on the track, advancing a second offset inking transfer device against the second side of the container, and advancing a second back-up roller against the first side of the container. The method further includes capturing the containers on the indented profiles formed on an outer cylindrical surface of the second back-up roller, printing onto the second side of the containers with the second offset inking transfer device, and curing the ink with a second ultra violet dryer. In one embodiment, the indented profiles of the first and second back-up roller includes a tip indentation and a body indentation and the step of capturing the containers includes capturing a tip portion of the container into the tip indentation and capturing a body portion of the container into the body indentation.

An advantage of the present invention includes use of an offset inking transfer device which is a fast and efficient technique for printing onto plastic vials. Another advantage is that the process herein described allows for mass labeling production i.e. quickly imprinting text and numeric information in significant production quantities. Another advantage is the apparatus and method can be used as a means for printing identifying information onto a container, without the use of prior art paper labels and/or glue.

Yet another advantage is that the imprinted vials are treated with an ultra violet dryer so that toxins are eliminated from the surface of the vials as well as to the internal portion of the vial. This is possible according to the present invention since the ink is cured and solidified before any ink can permeate through the walls and into the inner portion of the vial. Another advantage is that the imprinted vials can be used for medical purposes, and to get to the drug, the user can twist the top of the vial and open the vial. This can all be done since the ink of the printed material has been properly cured. Another advantage is that the ultra violet dryers make the ink impermeable in the plastic which is an important health and safety issue.

A feature of the present invention is that both sides of the vial are printed. Another feature is that printing can occur with a closed vial filled with a material. A feature of the invention is that a conveyor means is used to transport the vials for printing and treating. Another feature is the specially designed back-up rollers. Still another feature is the design of the back-up roller in conjunction with the printheads that captures the vial units for printing. Another feature is that the physical dimensions of the back-up rollers, which includes the size, shape and spacing of the vial units, can be easily changed in order to accommodate various size vials without having to retool the entire assembly line and components.

Yet another feature is the ultra violet light that cures the ink after printing. Another feature is the laser engraver that engraves the vials with various pertinent information. Still yet another feature is that in the preferred embodiment, multiple printing stations are provided. Still yet another feature is the use of multiple photo-eye sensors confirms the proper printing of the vials, and aids and synchronizes the process.

DETAILED DESCRIPTION OF THE PREFERRED EMBODIMENTS

Figure 1B:
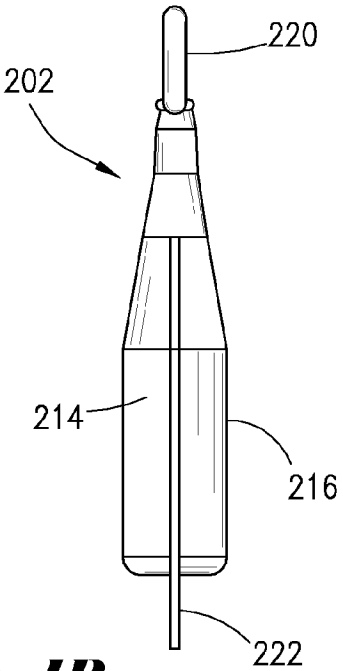
FIG. 1B is a side view of the vial unit seen in FIG. 1A.
Figure 1C:
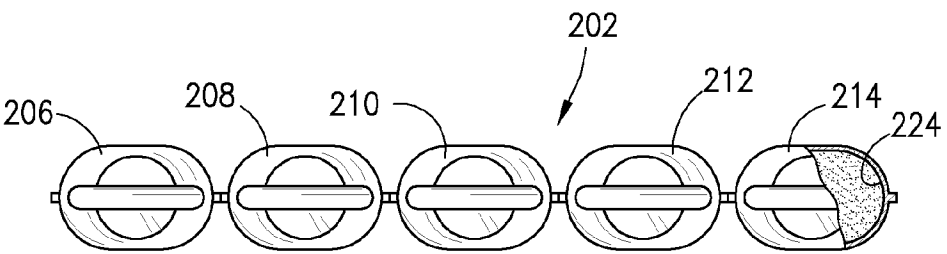
FIG. 1C is a top view of the vial unit seen in FIG. 1B.
Figure 1A:
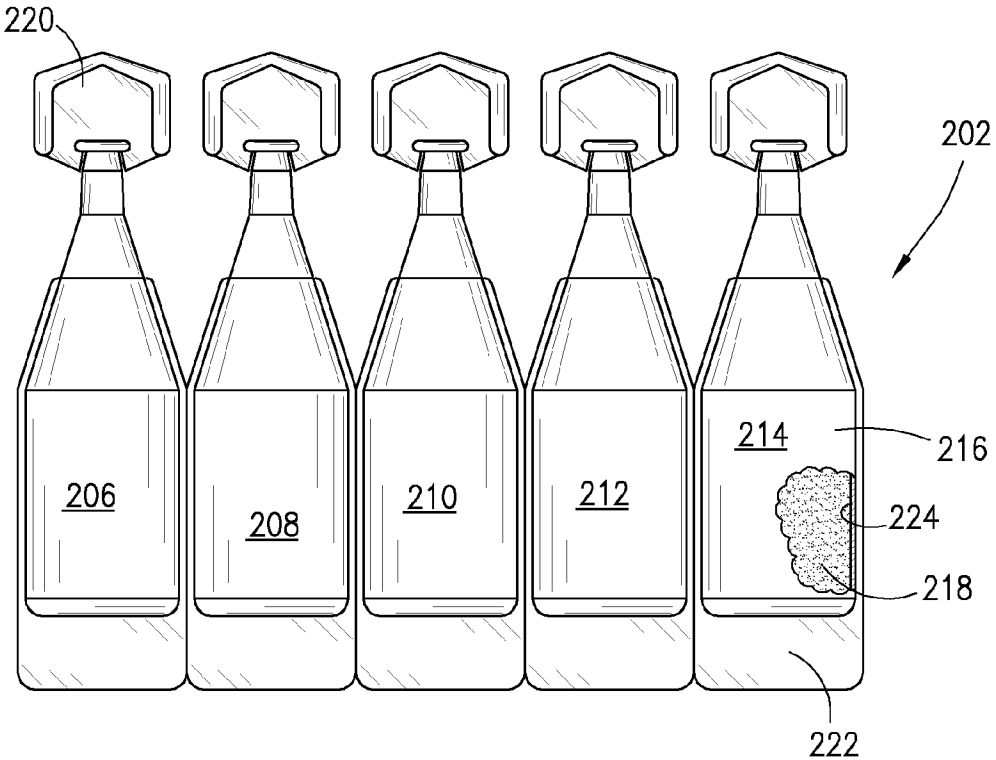
FIG. 1A is a front view of the preferred embodiment of the vial unit of the present invention.

Referring now to FIG. 1A, a front view of the preferred embodiment of the vial unit 202 of the present invention will now be described. The vial unit 202 contains five (5) individual vials that are interconnected, and wherein the vial unit 202 is molded as well understood by those of ordinary skill in the art. The process for producing the vial unit 202 includes producing the vial unit via blow molding, filling the individual vials with a product, and then closing and sealing the tops to obtain the vial unit 202. As shown in the most preferred embodiment, the individual vials of the vial unit 202 are closed containers. The five vials are interconnected, as seen in FIG. 1A. The individual vials, for instance vials 206, 208, 210, 212, 214, have a body portion that is generally cylindrical (see numeral 216). The body portion 216 has an inner portion, and wherein the inner portion is capable of holding liquids and/or solids, and wherein liquids and/or solids can be a drug 218. The body portion 216 leads to a tip portion 220, and wherein the tip portion 220 can be twisted so that the vial is opened and the user can obtain the contains of the vial. FIG. 1 also illustrates the flashing 222. The outer portion of the vial unit 202 may also be referred to as the outer contour.

FIG. 1B is a side view of the vial unit 202 seen in FIG. 1A, wherein the body 216 is shown as well as the tip 220. It should be noted that like numbers appearing in the various figures refer to like components. FIG. 1C is a top view of the vial unit 202 seen in FIG. 1B. This view also depicts the inner portion of the vials, for instance, inner portion 224. In use, the user detaches individual vials from the vial unit 202, twist the tip to open, and retrieves the contents of the vial. As used herein, a vial unit refers to five (5) interconnected vials (i.e. 202 in FIG. 1A) and the term vial units simply refers to more than one vial unit 202.

Figure 2A:
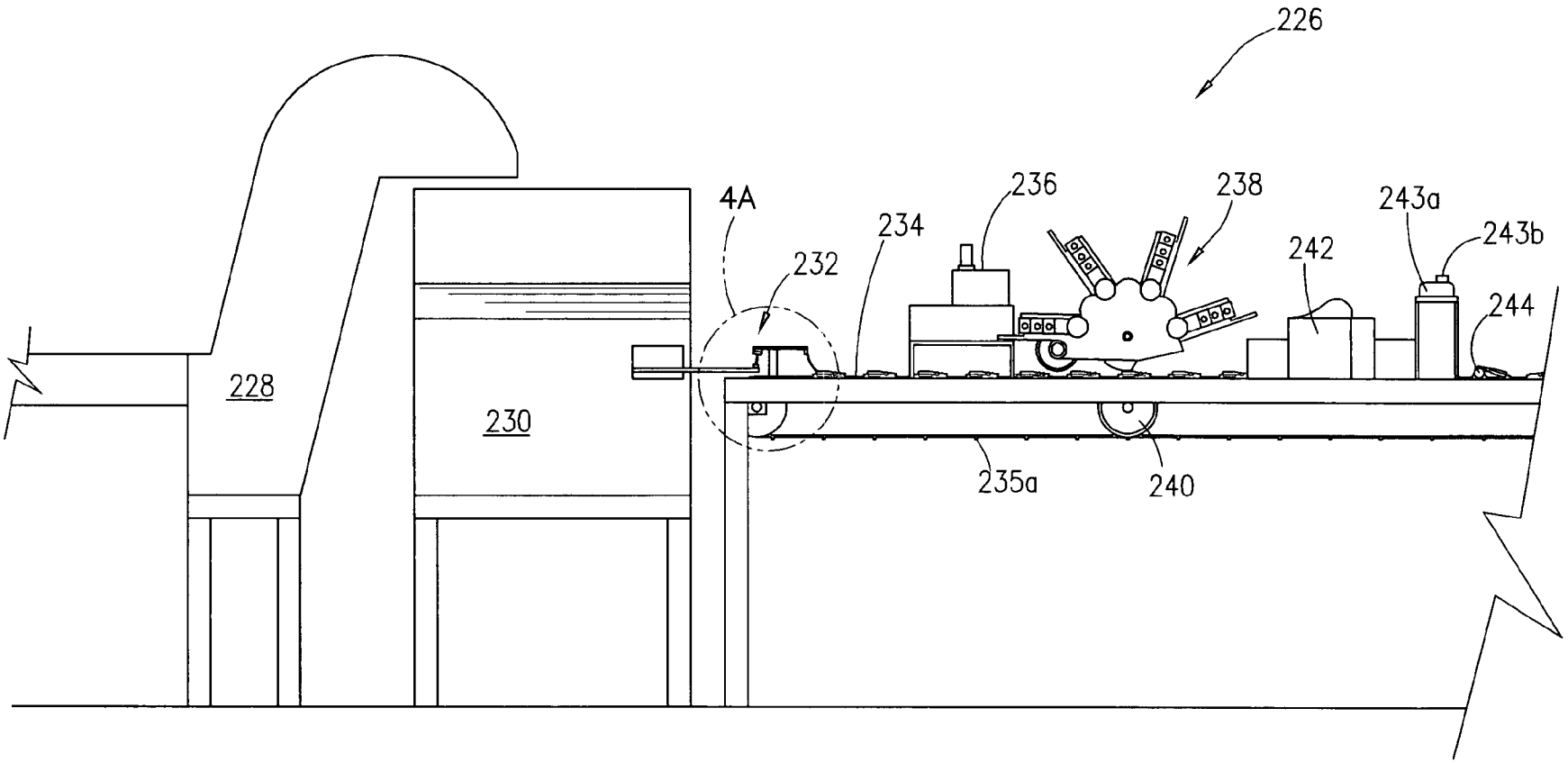
FIGS. 2A and 2B are perspective views of the most preferred embodiment of the printing system herein disclosed.
Figure 2B:
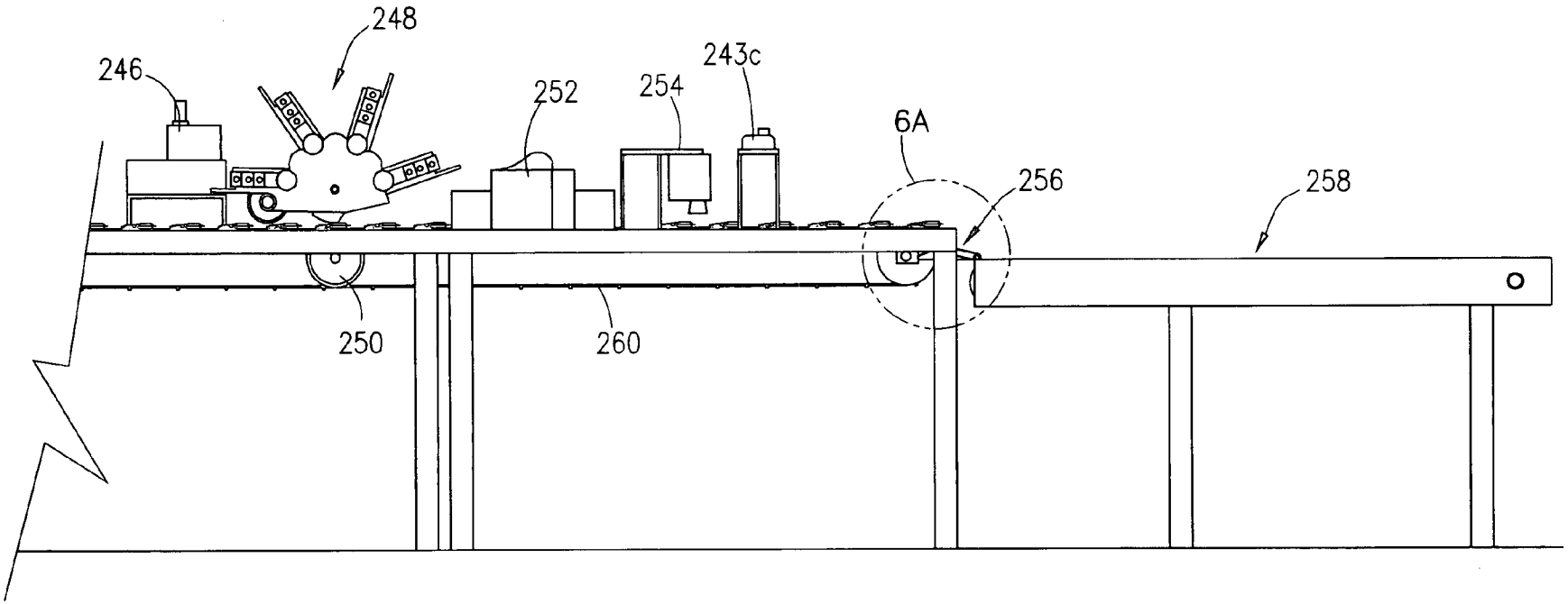

Referring now to FIGS. 2A and 2B, a perspective view of the most preferred embodiment of the printing system 226 will now be described. The printing system 226 includes a feed of the vial units from a form filled seal room to a part elevator 228, and wherein the part elevator 228 lifts and delivers the vial units to a bowl feeder 230. The bowl feeder 230 is commercially available from Service Engineering Inc. The bowl feeder 230 delivers the vial units to a loading means 232 for loading the vial units onto the conveyor belt 234. The conveyor belt 234 will have a series of spaced notches (sometimes referred to as cleats), for instance notch 235*a*, and wherein the vial units will be placed adjacent the notch so that the notch will engage the vial unit so that the vial unit advances with the conveyor belt. In one preferred embodiment, the loader 232 contains a timing gate means for placement of the vial units onto the conveyor belt, a photo eye means for detecting the proper placement of the vial unit and an alignment brush means for orienting the vial unit on the conveyor belt. The loader 232 will be described in greater detail in FIGS. 4A and 4B. Returning again to FIG. 2A, once the vial unit has been placed onto the conveyor belt 234, the vial unit will be exposed to a plasma treater means 236 for conditioning the outer surface of the vial unit for printing, and wherein the plasma treater means 236 is commercially available.

The conveyor belt 234 will then deliver the vial units to the first offset inking transfer device (also referred to as the first coat printheads, or just printheads) 238. A back-up roller 240 configured opposite the printhead 238 is also provided. The back-up roller 240 has a generally outer cylindrical surface, and wherein the cylindrical surface will have an indented profile for capturing the vial unit, as will be explained in greater detail with reference to FIGS. 5A and 5B. Returning to FIG. 2A, the back-up roller 240 will engage the vial unit relative to the printhead 238 so that the vial unit is captured in place for printing to the top side of the vial unit. After printing at the first printhead 238, the conveyor belt 234 moves the vial unit along to the ultra violet dryer 242, wherein the ultra violet dryer 242 is positioned to receive the vial unit and provide for drying of the ink pattern from the first printhead 238. The ultra violet dryer 242 is commercially available from Aetek UV Systems Inc. The print system 226 also includes a photo-eye device 243*a*, positioned downstream of the printheads 238 for determining whether the vial units are positioned adjacent the cleats and transmitting a signal to a control means 243*b* for controlling the printing process if the vial units are improperly positioned on the conveyor belt 234.

Next, the conveyor belt 234 moves the vial unit to a servo flipper means 244 for flipping the vial unit from its second side to a first side. In other words, the servo flipper means 244 turns the vial unit over relative to the conveyor belt 234. The flipper means 244 comprises a bar that engages the vial unit causing the vial unit to flip. The conveyor belt 234 then moves the vial unit to the second plasma treater means 246 (wherein the second plasma treater is similar to first plasma treater means 236). The conveyor belt 234 continues to move the vial unit to the second offset inking transfer device (sometimes referred to as the second printhead) 248 for printing onto the vial units, and in particular, for printing onto the second side of the vial units. A second back-up roller 250 is provided, and wherein the roller 250 is configured opposite the second printhead 248, with the roller 250 having a generally cylindrical outer surface having an indented profile for capturing the vial unit. The roller 250 is seen in greater detail in FIGS. 5A and 5B. Returning to FIG. 2B, the conveyor belt 234 will then move the vial unit to the ultra violet dryer 252 for drying the ink pattern from the second printhead.

The printing system 226 also includes the laser engraver 254, wherein the laser engraver 254 is commercially available from Laser Link Corp. under the name Smart Lase 130X. The print system 226 also includes a photo-eye device 243*c*, positioned downstream of the printheads 248 for determining whether the vial units are positioned adjacent the notches and transmitting a signal to the control means 243*b* for controlling the printing process if the vial units are improperly positioned on the conveyor belt 234. The photo-eye device 243*c* can also determine whether the proper images and data have been printed onto the unit vials. The conveyor belt 234 then delivers the vial unit to the ejector means 256 for ejecting the vial units from the conveyor 234 to a second conveyor system 258. As can be seen in FIG. 2B, the conveyor 234 loops around (see generally 260) so that the conveyor belt 234 can continue the cycle of printing to the vial units. The vial units containing the printing will be delivered to another station, for instance, to a packaging station.

Figure 3A:
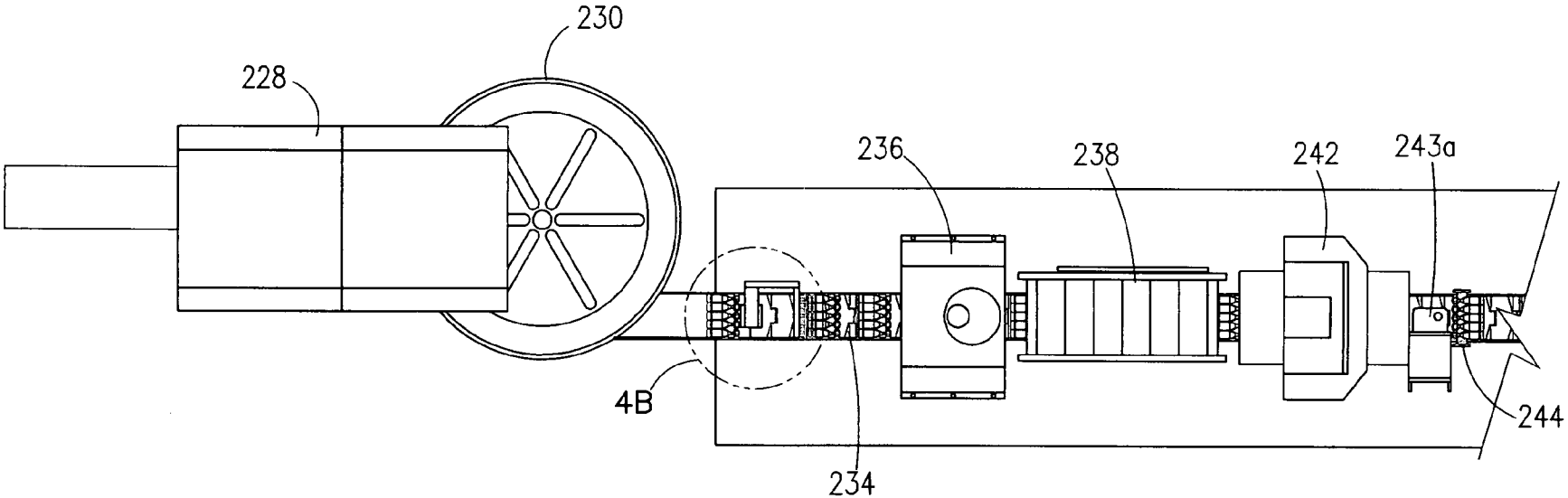
FIGS. 3A and 3B are top views of the printing system illustrated in FIGS. 2A and 2B.
Figure 3B:
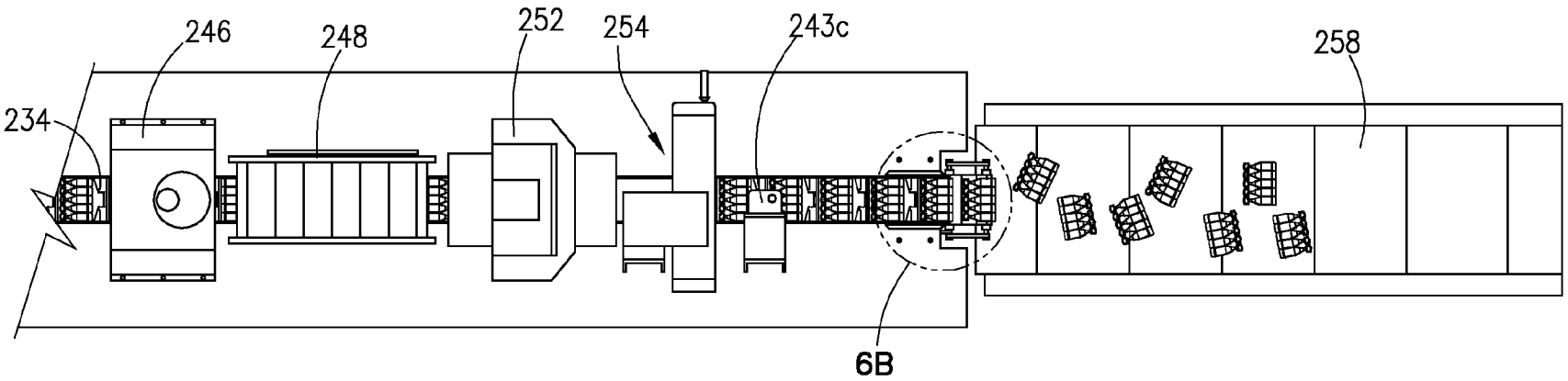

Referring now to FIGS. 3A and 3B, top views of the printing system illustrated in FIGS. 2A and 2B will now be described. It should be noted that like numbers appearing in the various figures refer to like components. Hence, the vial units are delivered to the bowl feeder 230 from the part elevator 228. The bowl feeder 230 places the vial unit onto the conveyor belt 234 and wherein the vial unit is led to the plasma treater 236, then the first side of the vial unit is printed with the printheads 238. After printing, the vial units, and in particular the ink, are exposed to the ultra violet dryer 242. The photo-eye 243*a* checks the position as well as the alphanumeric printed label for any errors. The vial unit is then flipped via the servo flipper means 244 so that the printed side is now face down on the conveyor belt 234 and the un-printed side is face up. The vial unit will then pass through the plasma treater 246 and in turn through the second printheads 248 for printing to the vial units (in this way, both sides of the vials are printed). Next, the ink will be cured as the vial unit is passed through the ultra violet dryer 252. The laser engraver 254 engraves an alphanumeric code and the photo-eye device 243*c* checks for any printing errors as well as proper positioning of the vial unit. As noted earlier, the vial units will then be ejected via the ejector means 256 (not seen in this view).

Figure 4A:
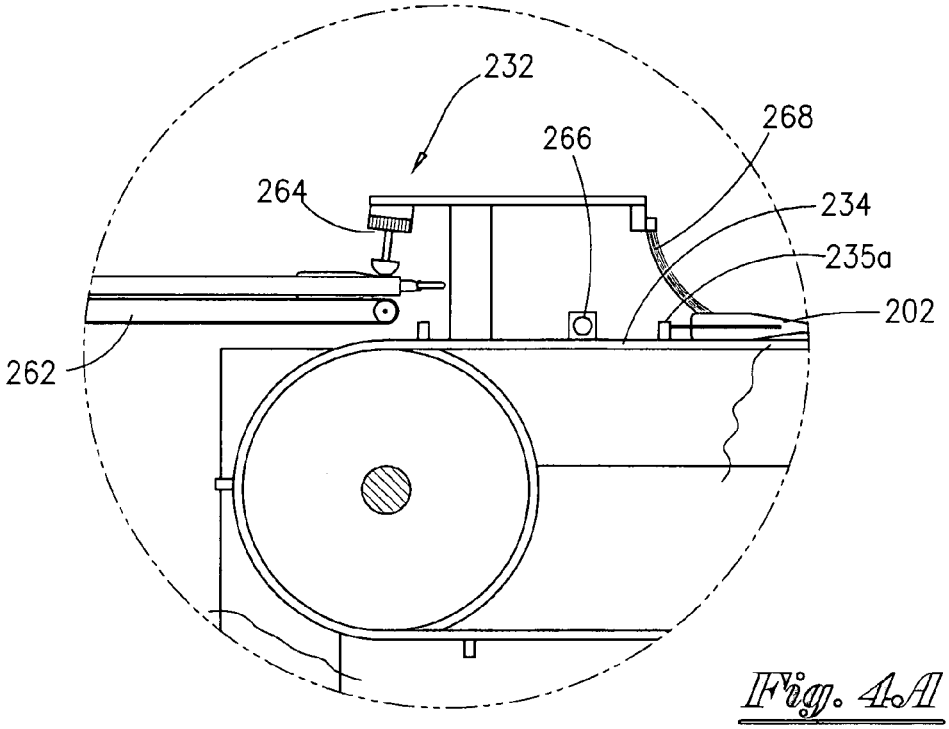
FIG. 4A is a side view of the vial unit loading mechanism shown encircled as 4A in FIG. 2A.

Referring now to FIG. 4A, a side view of the vial unit loading means 232 of the most preferred embodiment. In this most preferred embodiment, the bowl feeder 230 (not seen in this view) will deliver to the loading means 232 the individual vial units on the bowl feeder conveyor 262. In other words, the bowl feeder 230 will align the vial units onto the bowl feeder conveyor 262. The vial units on the conveyor 262 will abut the loading means 232. More specifically, the loading means 232 comprises a timing gate 264 that lifts and lowers and wherein the lifting and lowering allows an individual vial unit to be placed onto the conveyor belt 234 i.e. one vial unit at a time is placed onto conveyor 234. The loading means 232 also contains a photo-eye means 266 for synchronizing the opening and closing of the timing gate 264 based on the position of the individual vial unit, and wherein the photo-eye means 266 is commercially available from Keyence Corp. The photo-eye means 266 creates a light beam that in turn generates a signal that will be processed by the control means. As seen in FIG.

4A, the loading means 232 also contains the alignment brush 268, and wherein the bristles of the alignment brush 268 contact the vial unit causing the vial unit to properly abut the notches (cleats). For example, the vial unit 202 has a proximate end contacting the alignment brush 268 and the distal end contacting the cleat 235*a*.

Figure 4B:
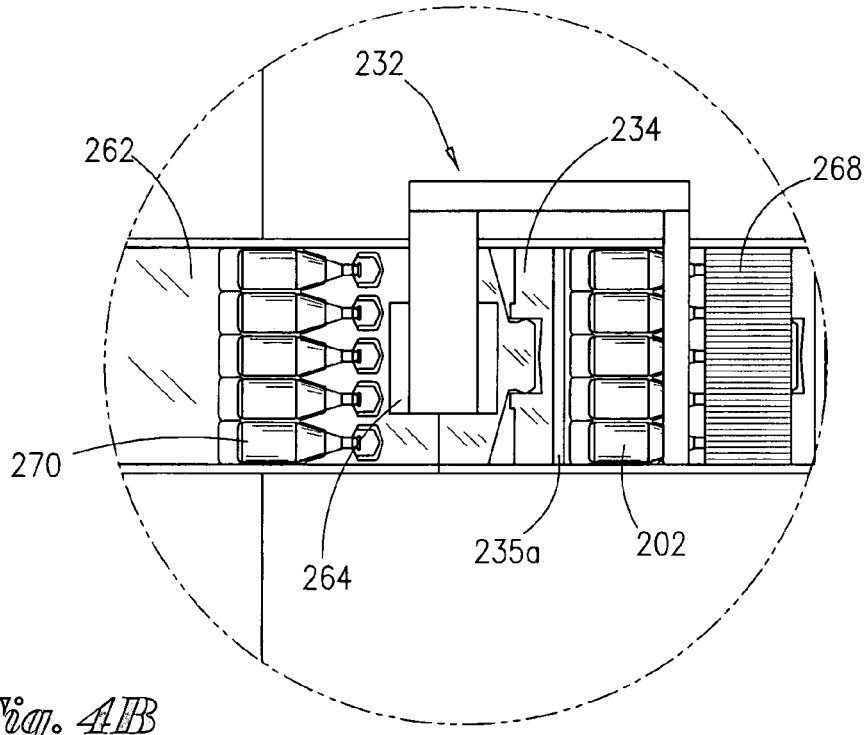
FIG. 4B is a top view of the vial unit loading mechanism illustrated in FIG. 4A and which is also shown encircled as 4B in FIG. 3A.

FIG. 4B is a top view of the vial unit loading means 232 illustrated in FIG. 4A. In this view, the conveyor 262 has positioned thereon a vial unit 270 being held-up by the timing gate 264. Also seen is the vial unit 202 that is positioned on the conveyor belt 234, and wherein the vial unit 202 is being pushed-up against the cleat 235*a* via the alignment brush 268 as previously mentioned.

Figure 5A:
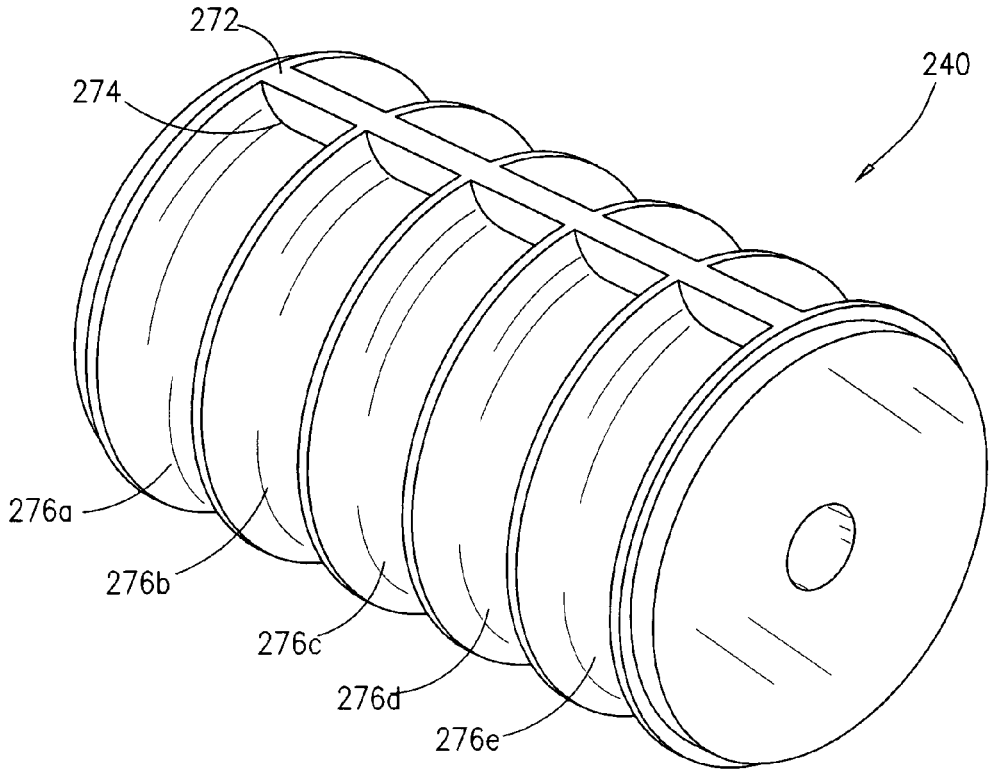
FIG. 5A is an isometric view of the most preferred embodiment of the roller mechanism.
Figure 5B:
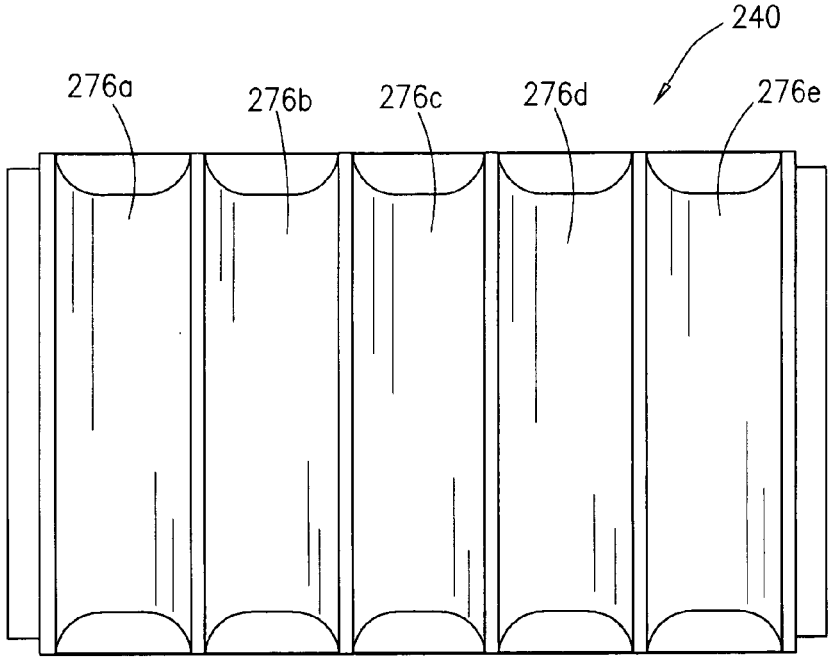
FIG. 5B is a side view of the roller mechanism seen in FIG. 5A.

Referring now to FIG. 5A, an isometric view of the most preferred embodiment of the first back-up roller means 240 will now be described. It should be noted that the first back-up roller means 240 and the second back-up roller means 250 are essentially identically and therefore only roller 240 will be described. As noted earlier, the first back-up roller means 240 has a generally cylindrical outer surface 272, wherein the outer surface 272 contains an indented profile 274 that is reciprocal to the actual profile of the vial unit. In other words, the indented profile 274 is reciprocal to the outer contour of the vial unit. As can be seen from FIG. 5A, the roller 240 contains five (5) indented rows which correspond to the five (5) vials contained in an individual vial unit. The five (5) rows include rows 276*a*, 276*b*, 276*c*, 276*d*, 276*e*. FIG. 5B is a side view of the roller mechanism 240 seen in FIG. 5A. FIG. 5B depicts the rows 276*a*, 276*b*, 276*c*, 276*d*, 276*e*.

Figure 6A:
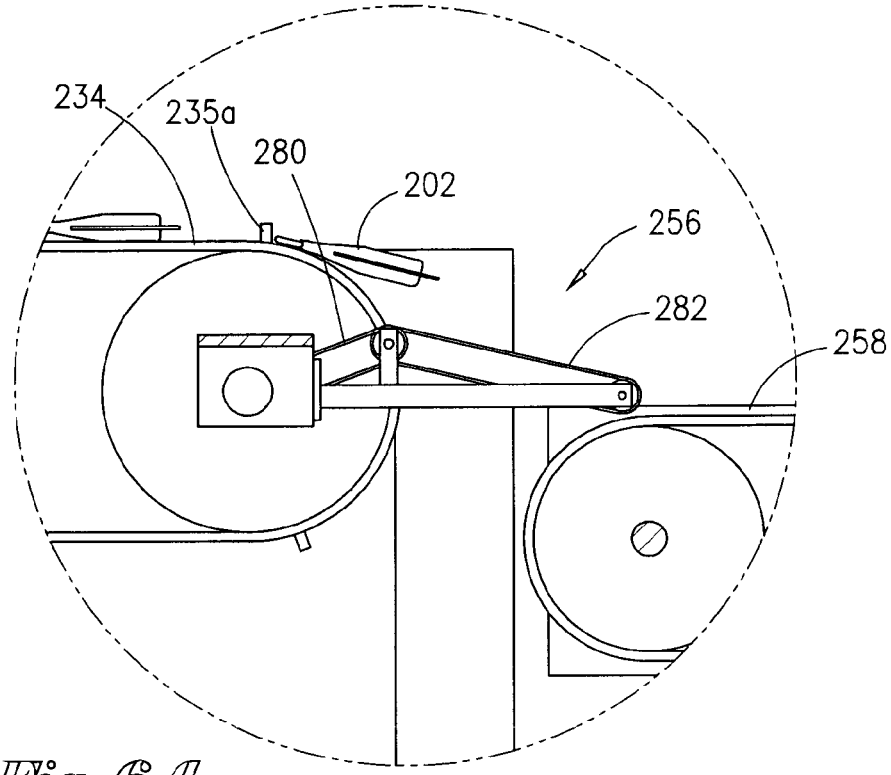
FIG. 6A is a side view of the most preferred embodiment of the ejector mechanism shown encircled as 6A in FIG. 2B.
Figure 6B:
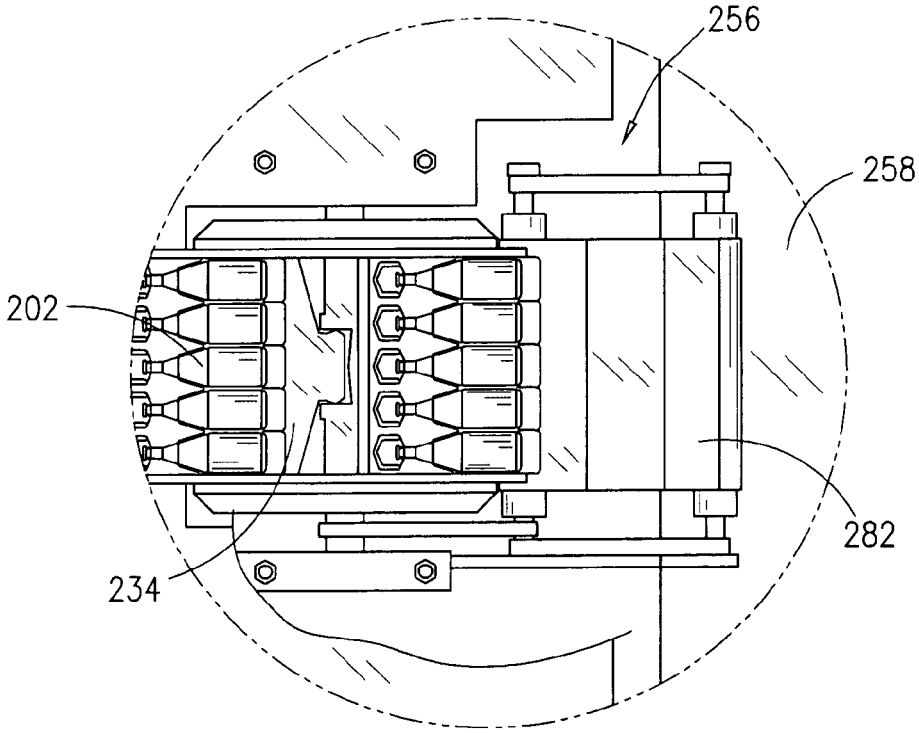
FIG. 6B is a top view of the ejector mechanism seen in FIG. 6A and which is also shown encircled as 6B in FIG. 3B.

FIG. 6A is a side view of the most preferred embodiment of the ejector means 256. In this preferred embodiment, the ejector means 256 includes a first ejector conveyor 280 and a second ejector conveyor 282, and wherein the vial unit 202 is conveyed via the cleat 235*a* until the vial unit 202 will fall (i.e. drop-off) from the conveyor belt 234. The vial unit 202 will land on the first ejector conveyor 280 which in turn will direct the vial unit 202 to the second ejector conveyor 282, and then onto the second conveyor system 258. FIG. 6B is a top view of the ejector means 256 seen in FIG. 6A, and wherein FIG. 6B depicts the vial unit 202 on conveyor belt 234. The second ejector conveyor 282 is shown in this view as well as the second conveyor system 258.

Figure 7:
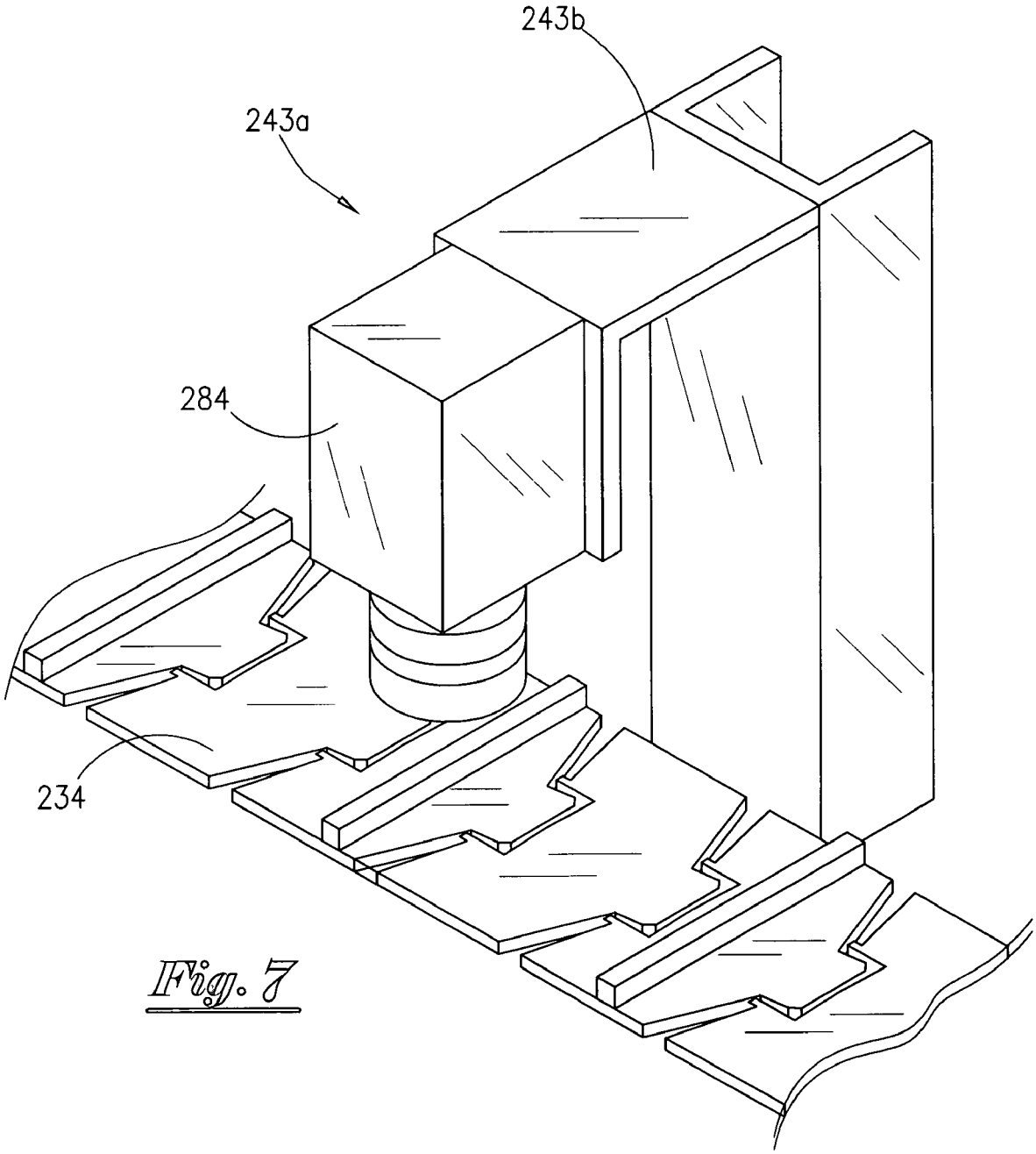
FIG. 7 is an isometric view of the camera system of the most preferred embodiment.

Referring to FIG. 7, an isometric view of the camera system of the most preferred embodiment will now be described. More specifically, FIG. 7 depicts the previously describe photo-eye device 243*a*, and wherein the camera 284 is positioned over the conveyor belt 234. The photo-eye device 243*a* will take digital pictures of the unit vials, and using processing means, compare the picture to a predetermined image to ensure that image on the unit vials was printed correctly. As seen in FIG. 7, the camera 284 is electrically connected to the control means 243*b* so that the digital images can be processed and analyzed. The camera 284 can also be used to help ensure proper positioning of the vial units on the conveyor 234.

Although this disclosure has been described and illustrated certain preferred embodiments of the invention, it is to be understood that the invention is not restricted to these particular embodiments. Rather, the invention includes all embodiments, which are functional, electrical or mechanical embodiments of the specific embodiments and features that have been described and illustrated herein.

I claim:

1. An apparatus for printing onto closed vial units, and wherein each of said vial units are comprised of a series of individual vials and said vial units each having an inner portion filled with a drug, and wherein said vial units each have a first side and a second side, the apparatus comprising:

a conveyor belt for moving the vial units through the apparatus, said conveyor belt having spaced cleats, and wherein said first side of said vial units is facing-up on said conveyor belt in a horizontal orientation, the conveyor belt transporting the vial units through a first printing unit;

the first printing unit including a first offset inking transfer device for printing a first ink pattern onto the vial units, said first side offset inking transfer device configured to print to said first side of each vial unit; the first printing unit further including a first back-up roller configured opposite said first offset inking transfer device, said first back-up roller being a cylindrical member and wherein said first back-up roller contains an indented profile placed about said cylindrical member and wherein said indented profile is reciprocal to an outer contour of each of said vial units; and a first ultra violet dryer positioned to receive the conveyor belt and vial units from the first offset inking transfer device and provide for drying of the first ink pattern from the first offset inking transfer device.

2. The apparatus of claim 1 further comprising:

means for flipping the vial units on said conveyor belt from laying on the second side to laying on the first side;

a second offset inking transfer device for printing a second ink pattern onto the vials units, said second side offset inking transfer device configured to print to said second side;

a second back-up roller configured opposite said second offset inking transfer device, said second back-up roller being a cylindrical member and wherein said second back-up roller contains an indented profile placed about said cylindrical member and wherein said indented profile is reciprocal of the outer contour to said vial units;

a second ultra violet dryer positioned to receive the vial units and provide for drying of the ink pattern from the second offset ink transfer device.

3. The apparatus of claim 2 wherein said first and second back-up rollers are rotatably mounted so that the rollers rotate in phase with the advancement of the vial units on the conveyor belt.

4. The apparatus of claim 3 wherein said vial units contain a tip portion and a body portion, and wherein said indented portion contains a receptacle tip portion and a receptacle body portion.

5. The apparatus of claim 4 further comprising:

ejector means for ejecting the vial units comprising a second conveyor belt to dispense said vial units.

6. The apparatus of claim 5 further comprising a brush configured to orient and position the vial units adjacent said cleats.

7. The apparatus of claim 6 further comprising: a hopper for feeding the vial units onto the conveyor belt; and, a photo-eye device, positioned downstream of the hopper, for determining whether the vial units are positioned adjacent said cleats and transmitting a signal to a control means if the vial units are improperly positioned on the conveyor belt.

8. The apparatus of claim 7 further comprising a laser engraver, positioned downstream of the first ultra violet dryer, in order to engrave an alpha numeric number onto the vial units.

9. The apparatus of claim 8 further comprising a plasma treater means, positioned upstream of the first offset inking transfer device, for surface treating the vial units in preparation of printing the first ink pattern on the vial units.

10. An apparatus for imprinting closed vial units, and wherein said vial units are comprised of a series of individual vial and said vial units each having an inner portion filled with a drug, and wherein said vial units each have a first side and a second side, the apparatus comprising:

a hopper for holding the vial units;

a conveyor belt for moving the vial units through the apparatus, the hopper configured to deliver the vial units to a conveyor belt; the conveyor belt transporting the vial units through a first printing unit, the first printing unit including a first offset inking transfer device for printing a first ink pattern onto the vial units, said first offset inking transfer device configured to print to said first side of each vial unit; the first printing unit further including a first back-up roller configured opposite said first offset inking transfer device, said first back-up roller being a cylindrical member and wherein said first back-up roller contains an indented profile placed about said cylindrical member reciprocal to said outer contour of each of said vial units; and a first ultra violet dryer positioned to receive the conveyor belt and vial units from the first offset inking transfer device and provide for curing of the first ink pattern from the first offset inking transfer device.

11. The apparatus of claim 10 further comprising: means for flipping the vial units on said conveyor belt from laying on the second side to laying on the first side.

12. The apparatus of claim 11 further comprising a brush configured to orient the vial units on the conveyor belt.

13. The apparatus of claim 12 further comprising:

a vial unit remover comprising a second conveyor belt to dispense the vial units.

14. The apparatus of claim 13 further comprising a photo-eye device, positioned downstream of the hopper, for determining whether the vial units are positioned on the conveyor belt and transmitting a signal to a control means in order to halt the conveyor belt if the vial units are improperly positioned on the conveyor belt.

15. The apparatus of claim 14 further comprising a laser engraver in order to engrave alpha numeric number onto the vial units.

16. The apparatus of claim 15 further comprising a plasma treater device, positioned upstream of the first offset inking transfer device so that the vial units are treated in preparation of the printing of the first ink pattern on the vial units.

17. The apparatus of claim 16 further comprising:

a second offset inking transfer device for printing a second ink pattern onto the vial units;

a second back-up roller configured opposite said second offset inking transfer device, said second back-up roller being a cylindrical member and wherein said second back-up roller contains an indented profile placed about said cylindrical member reciprocal to said vial units;

a second ultra violet dryer positioned to receive the vial units and provide for curing of the second ink pattern from the second offset ink transfer device.

* * * * *